US009896884B2

(12) United States Patent
Salmi et al.

(10) Patent No.: US 9,896,884 B2
(45) Date of Patent: Feb. 20, 2018

(54) TELESCOPIC LADDER FOR FIREFIGHTING VEHICLE

(71) Applicant: E-One, Inc., Ocala, FL (US)

(72) Inventors: James Salmi, Lititz, PA (US); Oliver Bruhn, Newmanstown, PA (US)

(73) Assignee: E-One, Inc., Ocala, FL (US)

( * ) Notice: Subject to any disclaimer, the term of this patent is extended or adjusted under 35 U.S.C. 154(b) by 79 days.

(21) Appl. No.: 15/085,675

(22) Filed: Mar. 30, 2016

(65) Prior Publication Data

US 2016/0305185 A1 Oct. 20, 2016

Related U.S. Application Data

(60) Provisional application No. 62/150,060, filed on Apr. 20, 2015.

(51) Int. Cl.

| | |
|---|---|
| ***E06C 5/04*** | (2006.01) |
| ***E06C 5/02*** | (2006.01) |
| ***E06C 5/00*** | (2006.01) |
| *E06C 5/06* | (2006.01) |

(52) U.S. Cl.

CPC ..... *E06C 5/04* (2013.01); *E06C 5/00* (2013.01); *E06C 5/02* (2013.01); *E06C 5/06* (2013.01)

(58) Field of Classification Search

CPC ..... E06C 5/00; E06C 5/02; E06C 5/04; E06C 5/06

See application file for complete search history.

(56) References Cited

U.S. PATENT DOCUMENTS

| | | | | | |
|---|---|---|---|---|---|
| 1,887,546 | A | * | 11/1932 | Cowell | E06C 1/12 182/207 |
| 1,943,724 | A | * | 1/1934 | Cowell | E06C 1/12 182/219 |
| 1,949,972 | A | * | 3/1934 | Murphy | E06C 1/12 182/212 |
| 2,704,178 | A | * | 3/1955 | Nilsson | E06C 1/12 182/207 |
| 3,921,758 | A | * | 11/1975 | Kozai | E06C 5/04 182/103 |
| 3,992,025 | A | * | 11/1976 | Amelio | A63C 17/01 280/87.042 |

(Continued)

FOREIGN PATENT DOCUMENTS

EP 0900910 3/2004

*Primary Examiner* — Colleen M Chavchavadze

(74) *Attorney, Agent, or Firm* — Hovey Williams LLP

(57) ABSTRACT

An telescopic ladder for a vehicle. The telescopic ladder comprises a first ladder section and a second ladder section, with each ladder section comprising a front portion and a rear portion and each including opposing sides extending from the front portion to the rear portion. The second ladder section is configured to telescopically extend from the first ladder section. The telescopic ladder further includes an extension support for facilitating the extension of the second ladder section from the first ladder section. The extension support includes at least one front roller assembly positioned adjacent to a front portion of the first ladder section, at least one pair of side roller assemblies positioned on the sides of the first ladder section, and at least one pair of cam-follower assemblies positioned on the sides of the second ladder section adjacent to the rear portion of the second ladder section.

12 Claims, 15 Drawing Sheets

(56) References Cited

U.S. PATENT DOCUMENTS

| | | | | |
|---|---|---|---|---|
| 4,047,727 | A * | 9/1977 | Holladay | A63C 17/01 280/11.28 |
| 4,130,320 | A * | 12/1978 | Scardenzan | A63C 17/01 301/5.7 |
| 7,100,741 | B2 * | 9/2006 | Wissler | E06C 5/04 182/207 |
| 8,056,676 | B2 * | 11/2011 | Argoud | A62L 31/14 182/239 |
| 8,074,767 | B1 * | 12/2011 | Denison | B66F 11/046 182/194 |
| 8,528,695 | B1 | 9/2013 | Orpia | |
| 2012/0129669 | A1 * | 5/2012 | Aoyama | B29C 70/22 492/47 |
| 2015/0345220 | A1 * | 12/2015 | Speck | A62C 27/00 182/67.4 |

* cited by examiner

TELESCOPIC LADDER FOR FIREFIGHTING VEHICLE

RELATED APPLICATIONS

This non-provisional patent application claims priority to U.S. Provisional Patent Application Ser. No. 62/150,060 filed on Apr. 20, 2015, and entitled "EXTENSION LADDER FOR AERIAL FIREFIGHTING VEHICLE," the disclosure of which is herein incorporated by reference in its entirety.

FIELD OF THE INVENTION

The present invention relates generally to a telescopic ladder for a firefighting vehicle. More specifically, the invention relates to a multiple-section telescopic ladder with an extension support system for facilitating extension and retraction of the ladder's multiple sections.

BACKGROUND

Firefighting vehicles, such as ladder trucks, are often equipped with aerial ladders configured to be rotated, raised, lowered, and extended. Certain aerial ladders may be extended in excess of one hundred feet, such as may be required to aid firefighters in fighting fires in multiple story buildings and/or in conducting rescues therefrom. Generally, aerial ladders are hydraulically operated, such that the ladders may be raised, rotated, and/or extended to an operative position and lowered and retracted to a stowed position.

Aerial ladders often comprise a plurality of individual ladder sections, which are configured to telescopically extend and retract with respect to each other. Specifically, the individual ladder sections of an aerial ladder are configured to telescopically extend from a retracted position so as to extend the entire reach of the ladder.

The individual ladder sections are often formed from high-strength material, such as steel or aluminum. As such, each of the individual ladder sections can weigh a significant amount, such that the individual ladder sections may undergo significant frictional forces (i.e., static and dynamic friction) during extension and retraction. Furthermore, when the ladders are extended and/or at least partially raised in an operational configuration, significant forces are applied to the individual ladder sections due to the weight of the individual ladder sections and due to any personnel or equipment supported thereon.

Accordingly there exists a need for an aerial ladder with an extension support system for supporting the significant weight of individual ladder sections of the aerial ladder and for minimizing the frictional forces experienced by the individual ladder sections during extension and retraction.

SUMMARY OF THE INVENTION

In one embodiment of the present invention, there is provided a firefighting vehicle comprising a vehicle body, a telescopic ladder attached to the vehicle body, and an extension support for facilitating the extension of the second ladder section with respect to the first ladder section. The telescopic ladder includes a first ladder section and a second ladder section, with the second ladder section being configured to telescopically extend from the first ladder section. The extension support provides for the second ladder section to extend from the first ladder section while experiencing a coefficient of friction of less than 0.10.

In another embodiment of the present invention, there is provided a telescopic ladder for a vehicle. The telescopic ladder comprises a first ladder section and a second ladder section, with the second ladder section being configured to telescopically extend from the first ladder section, and an extension support for facilitating the extension of the second ladder section from the first ladder section. The extension support provides for the second ladder section to extend from the first ladder section while experiencing a coefficient of friction of less than 0.075. Furthermore, the extension support does not require the use of lubrication.

In still another embodiment of the present invention, there is provided a method of operating a telescopic ladder for a vehicle, with the telescopic ladder including at least a first ladder section and a second ladder section, and with the second ladder section being configured to telescopically extend and retract from the first ladder section. The method comprises the initial step of extending the second ladder section with respect to the first ladder section. During the extending step, the second ladder section is at least partially vertically supported by a front roller assembly located on a front portion of the first ladder section and at least partially vertically supported by a cam-follower assembly located on a rear portion of the second ladder section. The method comprises the additional step of retracting the second ladder section with respect to the first ladder section.

In yet another embodiment of the present invention, there is provided a telescopic ladder for a vehicle. The telescopic ladder comprises a first ladder section and a second ladder section, with each ladder section comprising a front portion and a rear portion and each including opposing sides extending from the front portion to the rear portion. The second ladder section is configured to telescopically extend from the first ladder section. The telescopic ladder further includes an extension support for facilitating the extension of the second ladder section from the first ladder section. The extension support includes at least one front roller assembly positioned adjacent to the front portion of the first ladder section, at least one pair of side roller assemblies positioned on the sides of the first ladder section, with side roller assemblies from each pair laterally aligned with respect to the first ladder section, and at least one pair of cam-follower assemblies positioned on the sides of the second ladder section adjacent to the rear portion of the second ladder section.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE FIGURES

Embodiments of the present invention are described herein with reference to the following drawing figures, wherein.

Figure 1:
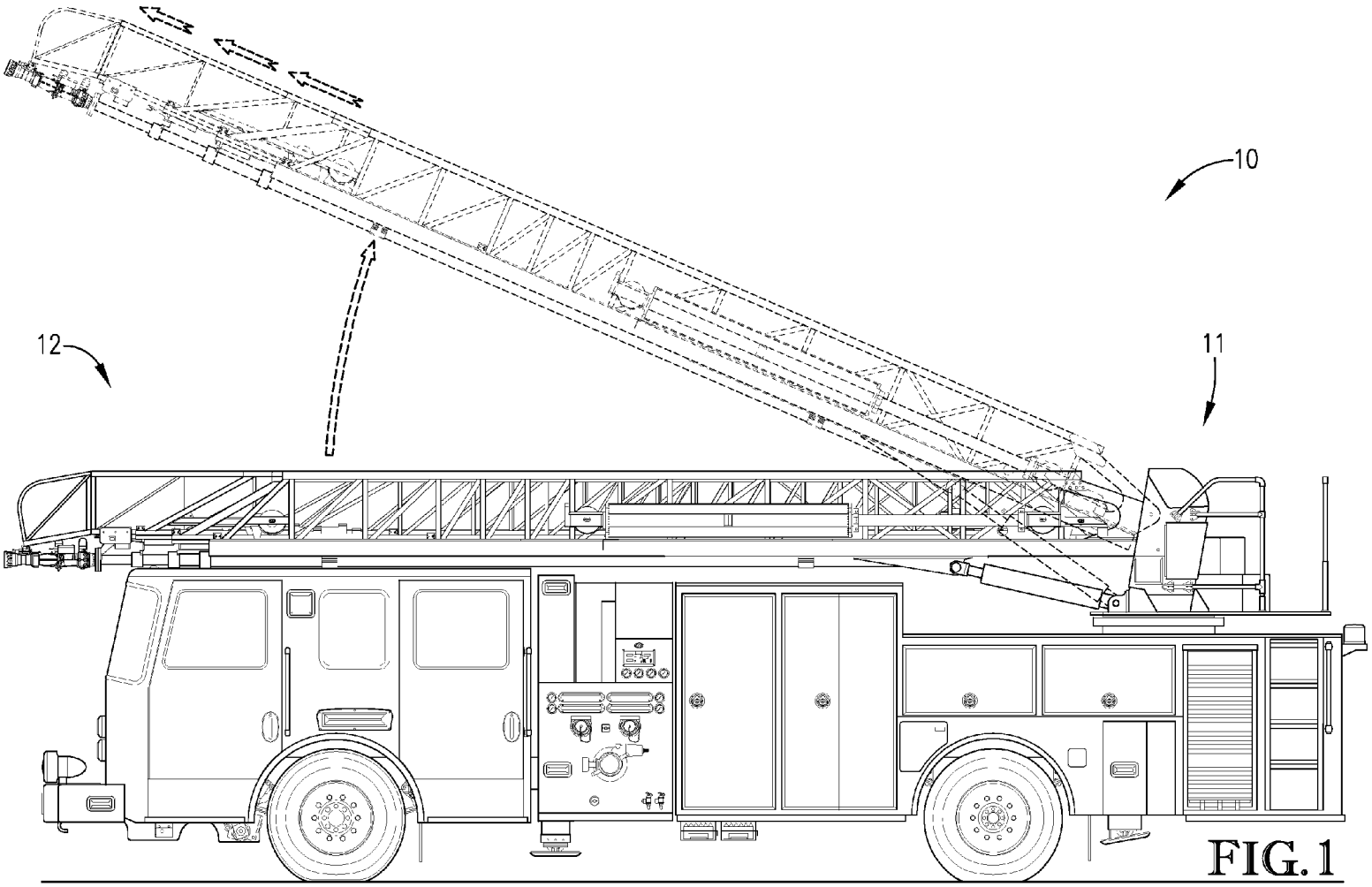
FIG. 1 is side elevation view of a firefighting vehicle with a telescopic ladder according to embodiments of the present invention, with the telescopic ladder in a retracted position.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Figure 2:
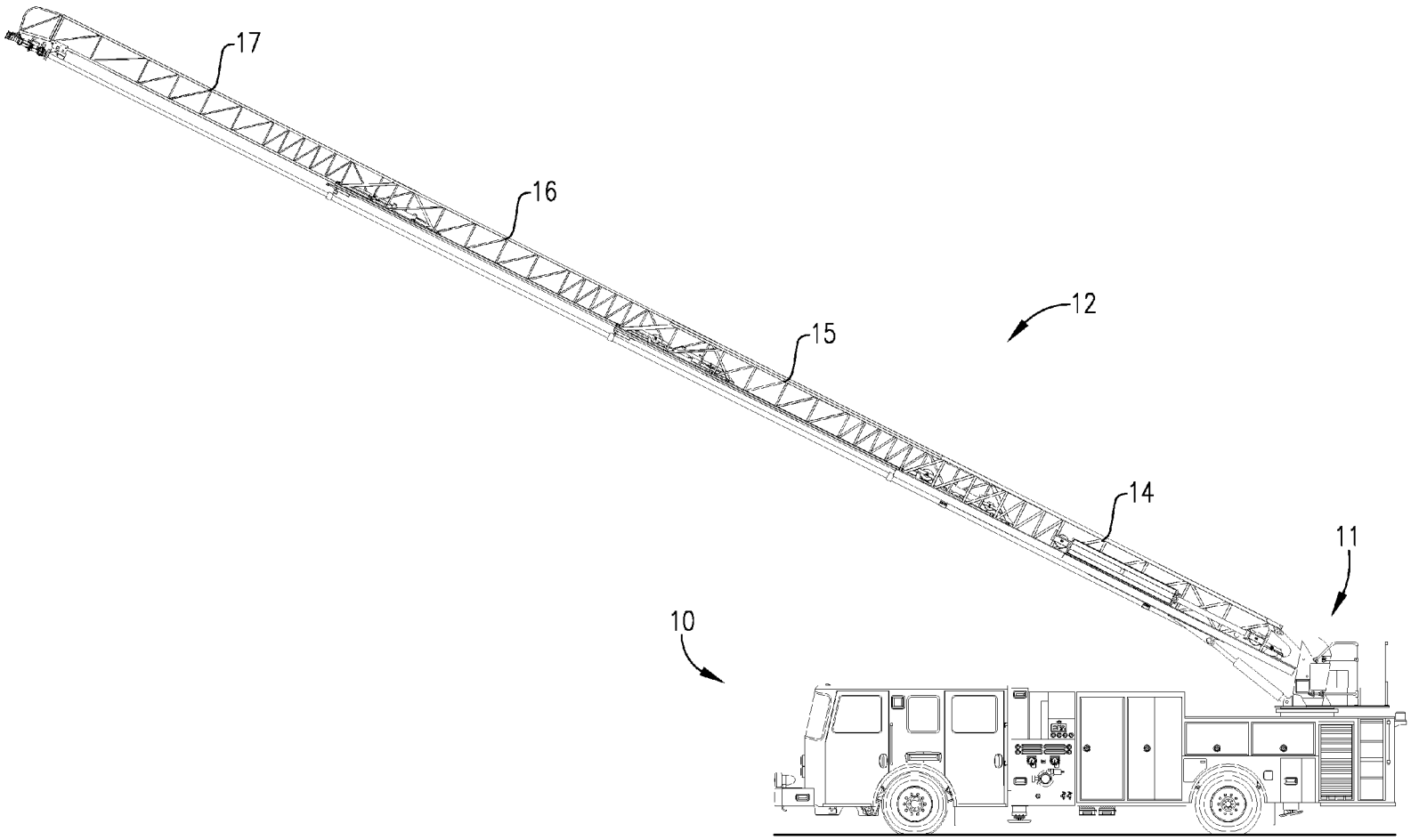
FIG. 2 is side elevation view of the firefighting vehicle from FIG. 1, with the vehicle shown in a smaller scale to illustrate the telescopic ladder in an extended position.

Embodiments of the present invention generally relate to multiple-section aerial ladders for firefighting vehicles, and particularly to an extension support system for supporting each of the sections of the aerial ladder and for improving the function of such sections during extension and retraction. The present invention can be employed in emergency vehicles, such as firefighting vehicles and/or trucks similar to those described and illustrated in U.S. Pat. Nos. 4,570,973 and 5,368,315, the entire disclosures of which are incorporated herein by reference. FIGS. 1-2, depict an exemplary aerial firefighting vehicle 10 on which a ladder 12 of the present invention can be integrated. The ladder 12 may be configured to rotate and pivot with respect to the vehicle 10, via a ladder connection 11 from which the ladder 12 is rotatably secured (in both horizontal and vertical directions) to the vehicle 10.

Figure 3:
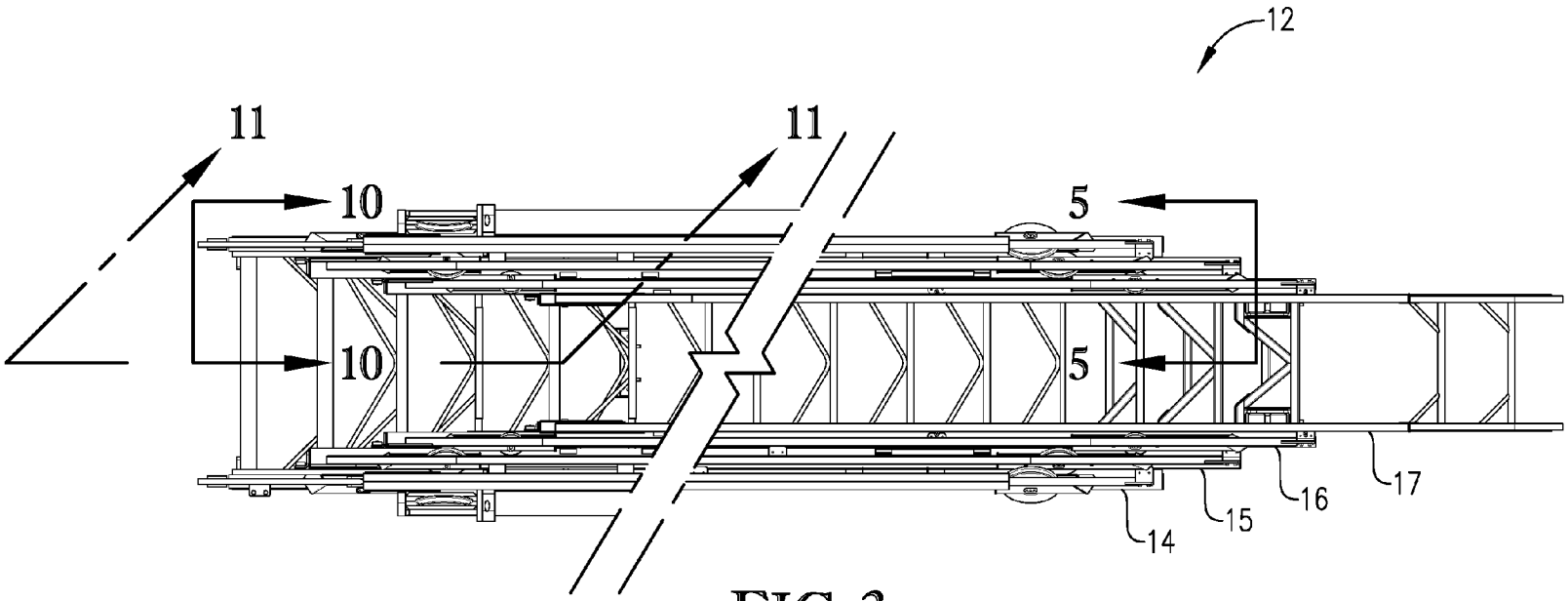
FIG. 3 is a top partial plan view of the telescopic ladder from FIG. 1.

FIG. 1 is illustrative of the ladder 12 in a retracted position, while FIG. 2 is illustrative of the ladder 12 in an extended position. As perhaps best shown by FIGS. 2 and 3, the ladder 12 includes multiple ladder sections 14, 15, 16, and 17, which are configured to actuate so as to extend and retract the ladder 12. Although the figures illustrate a ladder 12 with four ladder sections, it should be understood that the ladder 12 may have more or less than four ladder sections. As shown, each of the ladder sections 15, 16, and 17 may telescopically extend with respect to ladder sections 14, 15, and 16, respectively, such that the ladder 12 will transition from the retracted position (i.e., FIG. 1) to the extended position (i.e., FIG. 2). As such, ladder sections 14, 15, and 16 may be referred to as lower ladder sections when referenced in relation to ladder sections 15, 16, and 17, respectively. Likewise ladder sections 15, 16, and 17 may be referred to as upper ladder sections when referenced in relation to ladder sections 14, 15, and 16, respectively. For instance, ladder section 14 may be a lower ladder section with respect to section 15, and section 15 may be an upper ladder section with respect to section 14. Similarly, section 15 may be a lower ladder section with respect to section 16, and section 16 may be an upper ladder section with respect to section 15. Similarly, section 16 may be a lower ladder section with respect to section 17, and section 17 may be an upper ladder section with respect to section 16. As such, each of the upper ladder sections (i.e., sections 15, 16, and 17) is configured to telescopically extend with respect to its adjacent lower ladder section (i.e., sections 14, 15, and 16).

Figure 4:
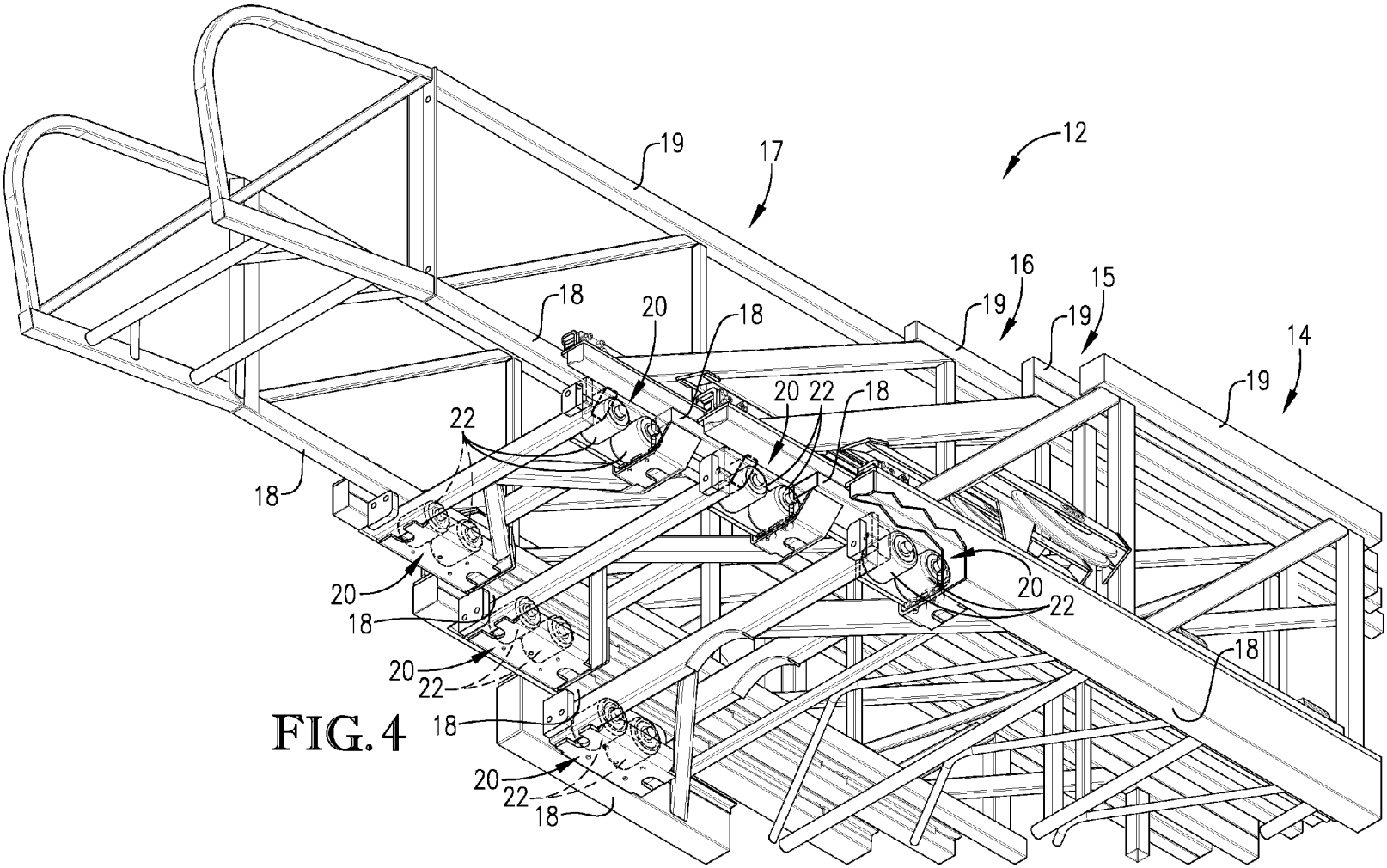
FIG. 4 is a bottom partial perspective view of the telescopic ladder from FIG. 3.
Figure 5:
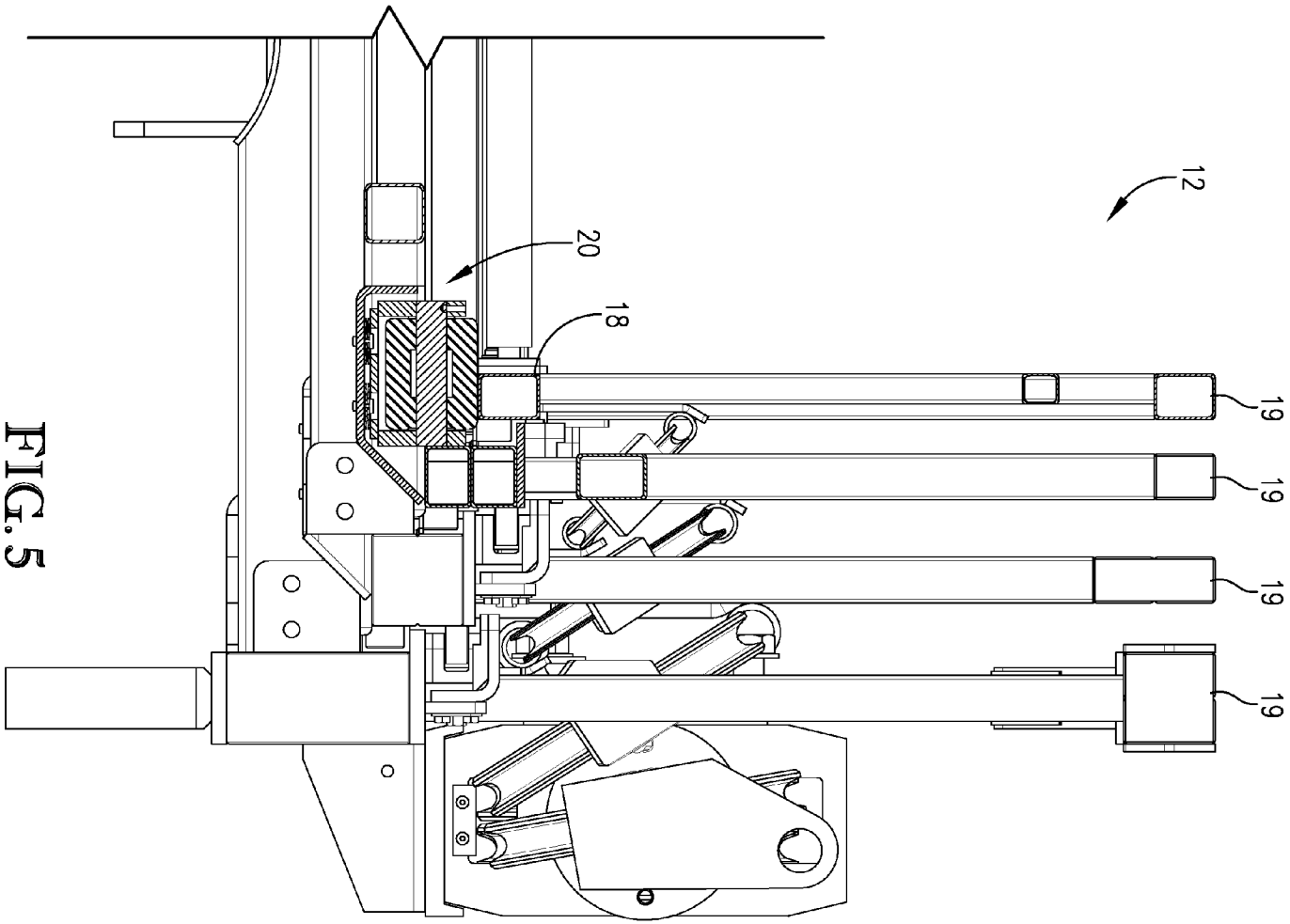
FIG. 5 is a cross-section of the telescopic ladder of FIG. 3 taken along the line 5-5.

With reference to FIG. 4, each of the ladder sections 14, 15, 16, and 17 of the ladder 12 may include a pair of base rails 18 and a pair of top rails 19 (only one of each of the pairs of top rails 19 are in view in FIG. 4). The base rails 18 of each of the ladder sections 14, 15, 16, and 17 may be interconnected via support members extending therebetween. Similarly, each of the top rails 19 may be interconnected to one of the base rails 18 via support members extending therebetween. The base rails 18, top rails 19, and the support members may be formed from material with high strength and durability, such as steel, aluminum, or the like. In some embodiments portions of the ladder 12, such as the base rails 18, will be coated with a corrosion-resistant material, such as zinc, to reduce the amount of corrosion that can affect the ladder 12 over time. For instance, ladders can deteriorate due to corrosion that results from the rollers repeatedly and/or continuously contacting the surfaces of the ladders during use. Embodiments of the present invention reduce such deterioration by incorporating a corrosion-resistant material, such as zinc, on the surface of the ladders.

The upper ladder sections 15, 16, 17 may be caused to extend via one or more actuating mechanisms. In some embodiments, section 15 can be extended from within section 14 via hydraulic actuation. Specifically, a hydraulic actuator can act on a rear portion of section 15, thereby causing section 15 to extend from section 14. As used herein with respect to the ladder sections 14, 15, 16, 17, the term "rear" means a position or direction proximally directed towards the ladder connection 11, which as described above, connects the ladder 12 with the vehicle 10. Alternatively, the term "front" means a position or direction distally directed away from the ladder connection 11. The term "right" means a right-side direction when viewing from the ladder connection 11 distally along a length of the ladder 12, and the term "left" means a left-side direction when viewing from the ladder connection 11 distally along the length of the ladder 12. Returning to the description of the actuating mechanisms, in some embodiments, the hydraulic actuator may be used to extend the remaining upper ladder sections 16, 17. In other embodiments, however, other types of actuating mechanisms may be used to cause the upper ladder sections 15, 16, 17 to extend and retract. For example, a cylinder and cable system, a winch and pulley system (e.g., a cable system), a chain system, a gear system, pneumatic system, or the like, or combinations thereof may be used.

To facilitate the extension and retraction of the upper ladder sections 15, 16, 17, embodiments of the present invention may include an extension support system for supporting each of the upper ladder sections 15, 16, 17. As will be discussed in more detail below, the extension support system may broadly comprise front roller assemblies, side roller assemblies, and cam-follower assemblies, each of which will be described below with reference to the drawings.

Figure 6:
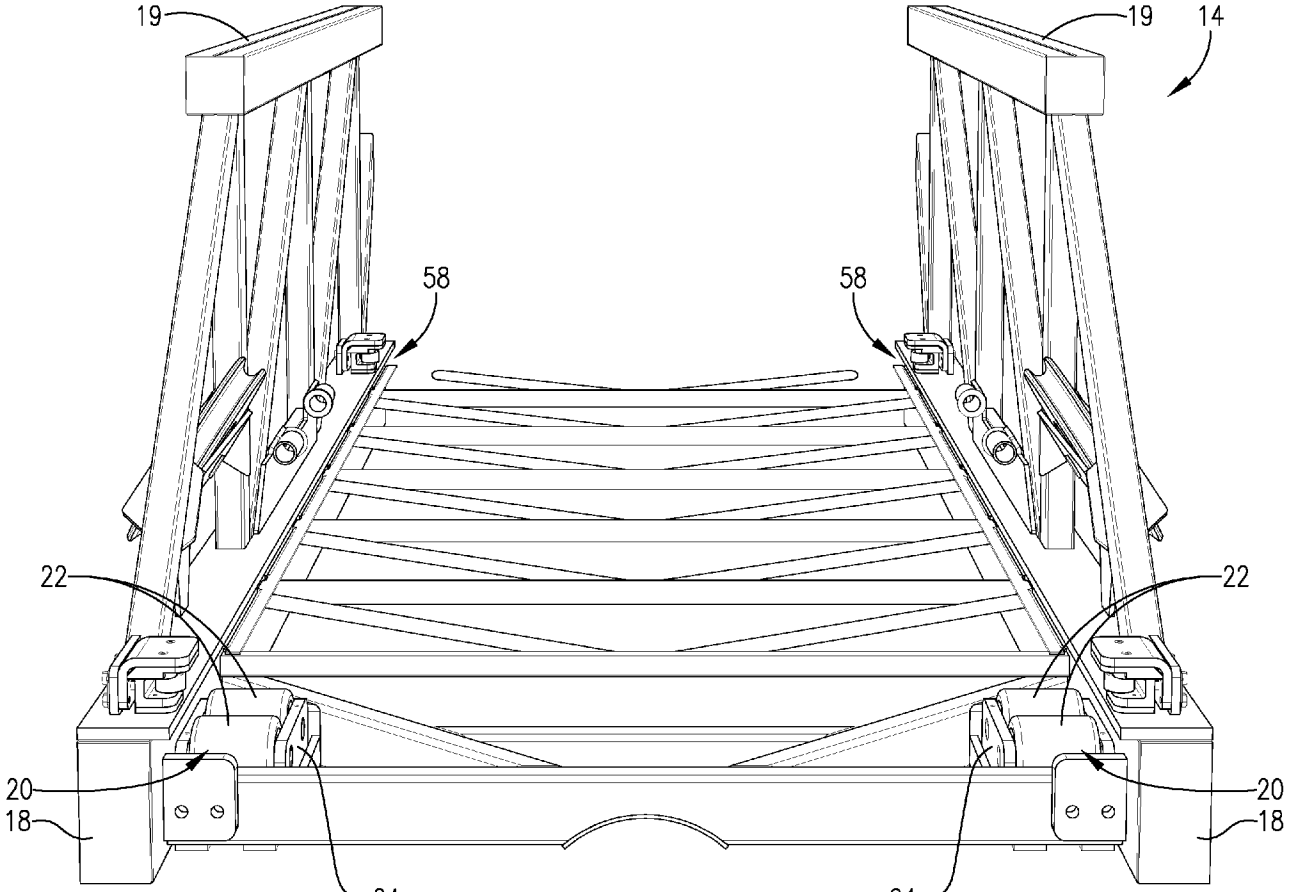
FIG. 6 is a front perspective view of a first bottom section of the telescopic ladder of FIG. 3.

With reference to FIGS. 4-7, the extension support system may include front roller assemblies 20 located a front portion of each of the lower ladder sections 14, 15, 16. As perhaps best shown by FIG. 6, some embodiments of the ladder 12 may include two front roller assemblies 20 on each of the ladder sections 14, 15, 16 (only ladder section 14 is shown in FIG. 6), with one roller assembly 20 positioned on each of the left and ride sides of the front portions of the lower ladder sections 14, 15, 16. As perhaps best shown by FIG. 7, in some embodiments, each of the roller assemblies 20 may comprise two or more front rollers 22 rotatably secured within a front bracket 24 coupled with the lower ladder sections 14, 15, 16 (only lower ladder section 16 shown in FIG. 7).

In such a configuration, and with reference to FIG. 4, the upper ladder sections 15, 16, 17 are configured to telescopically extend from the lower ladder sections 14, 15, 16 by rolling on the front roller assemblies 20. Specifically, a bottom surface of the base rails 18 of the upper ladder sections 15, 16, 17 are positioned on and are configured to roll across the front rollers 22 of the roller assemblies 20. The ability of the upper ladder sections 15, 16, 17 to roll on the front roller assemblies 20 significantly reduces the friction experienced between the upper and lower ladder sections during extension and retraction. Furthermore, the front rollers 22 may allow for more uniform frictional forces to be applied to the base rails 18 of the upper ladder sections 15, 16, 17, thereby allowing for smoother operation than previously-used pad systems. Although configured to reduce friction, the mechanical strength of the front roller assemblies 20 is sufficient to support the upper ladder sections 15, 16, 17 during extension and retraction, as well as while the upper ladder sections 15, 16, and 17 are in static positions.

Figure 7:
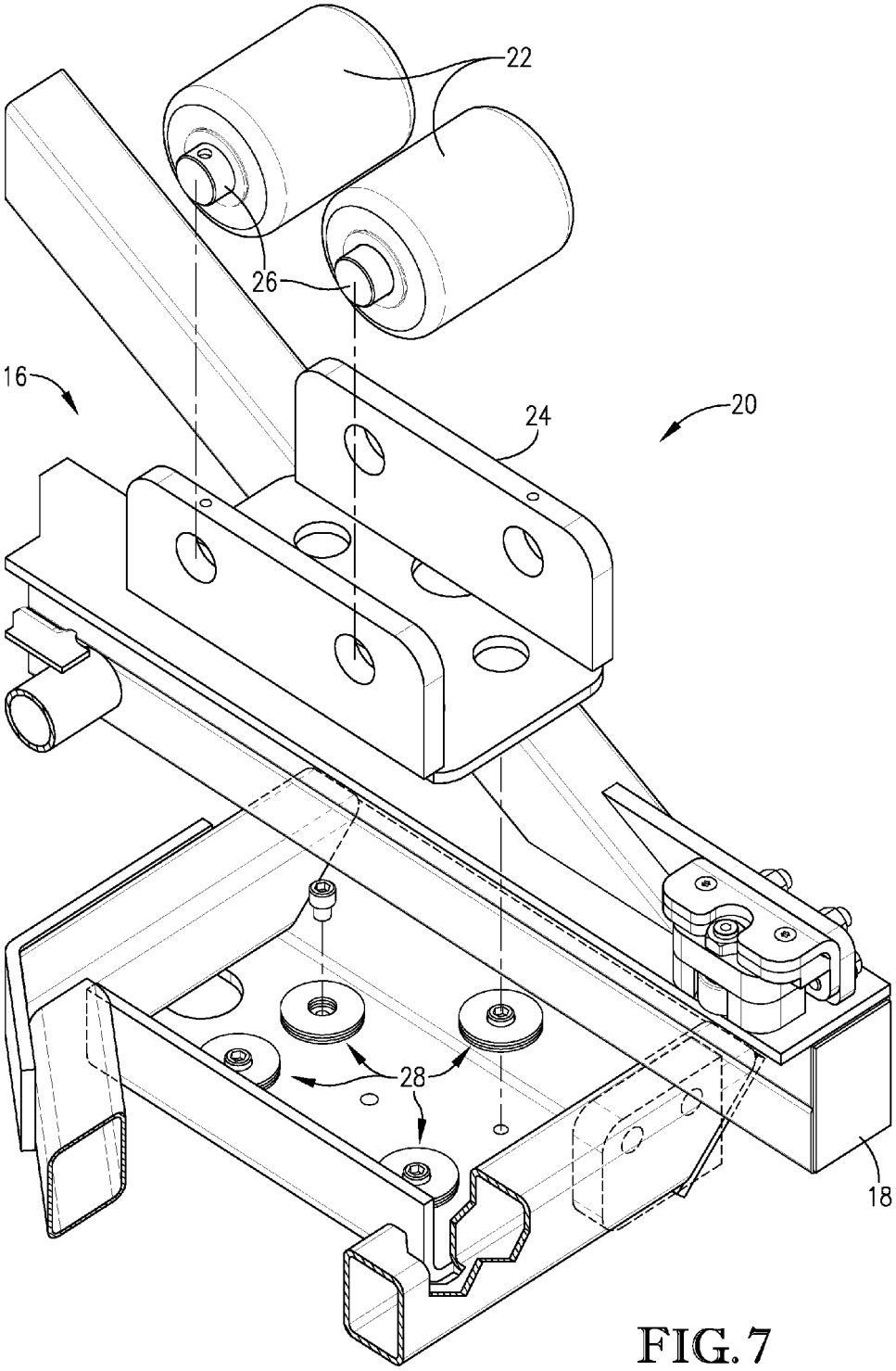
FIG. 7 is a perspective exploded view of a front roller assembly from a third bottom section of the telescopic ladder of FIG. 3.

Remaining with FIG. 4, the front roller assemblies 20 may be secured to the lower ladder sections 14, 15, 16, such that the front rollers 22 are orientated along a horizontal axis of rotation extending perpendicularly between the base rails 18 of the ladder 12. As used herein with reference to the rollers described throughout this description, the term horizontal means horizontal with respect to the ladder section 14, 15, 16, 17 with which the rollers are associated, and the term vertical means vertical with respect to the ladder section 14, 15, 16, 17 with which the rollers are associated. As shown in FIG. 7, the front rollers 22 are supported within the front bracket 24 by way of pins 26 that are secured to the front bracket 24 and that extend along the axis of rotation of their associated front roller 22. The front roller assemblies 20 may additionally include roller bearings, washers, end-caps, and the like, which allow the pins 26 and the front rollers 22 to be secured in position, while facilitating the ability of the front rollers 22 to freely rotate about their axes of rotation.

Given the above, the front roller assemblies 20 positioned on lower ladder section 14, 15, and/or 16 are configured to facilitate extension and retraction of upper ladder sections 15, 16, and/or 17 respectively, by allowing the upper ladder sections 15, 16, and/or 17 to extend or retract by rolling on top of the front roller assemblies 20. The front rollers 22 may be formed from various materials that provide sufficient strength, durability, and reduced friction. For instance, in some embodiments, the front rollers 22 may be formed from a polymer, such as from polyurethane. Embodiments of the present invention may provide for the front rollers 22 to have an outer diameter of at least 3 inches, at least 3.25 inches, at least 3.5 inches, at least 3.75 inches, or at least 4 inches, and/or no more than 6 inches, no more than 5.75 inches, no more than 5.5 inches, no more than 5.25 inches, or no more than 5 inches.

With particular reference to FIGS. 6-7, the front brackets 24 may be formed as C-channel brackets secured to and supported on the front portions of lower ladder sections 14, 15, 16 (only lower ladder section 14 shown in FIGS. 6-7). In particular, the front brackets 24 may be secured to the base rails 18 and/or to the support members connected between the base rails 18. In some embodiments, the front brackets 24 may be secured to the base rails 18 or to the support members via weldments that are secured to the base rails 18 or to the support members. The front brackets 24 may be secured to the lower ladder sections 14, 15, 16 (e.g., to the weldments) via one or more elastic devices 28, such as elastomeric materials, springs, or the like. In some embodiments, such as illustrated in the figures, the elastic devices 28 may comprise Belleville springs. In certain embodiments, each front bracket 24 will include at least two elastic devices 28 positioned generally under each of the front rollers 22 (i.e., for a total of four elastic devices 28). As such, the elastic devices 28 are configured to permit the front bracket 24 to pivot about two axes of rotation, such that each of the front rollers 22 will maintain consistent and simultaneous contact with the base rails 18 of the upper ladder section 15, 16, 17, which are being supported by the front roller assemblies 20 during extension and/or retraction.

Figure 8:
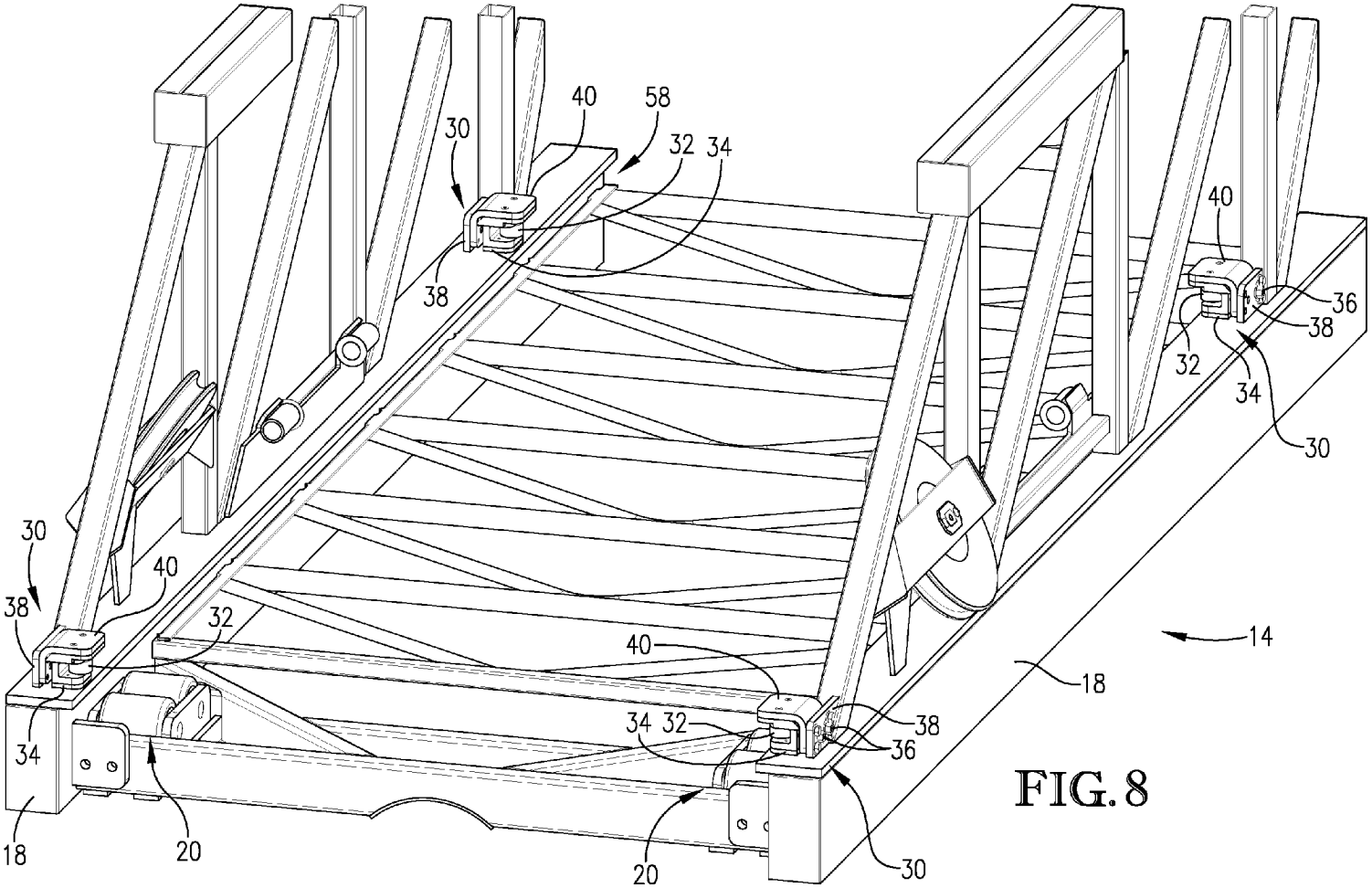
FIG. 8 is a front left perspective view of the first bottom section of FIG. 6.
Figure 9:
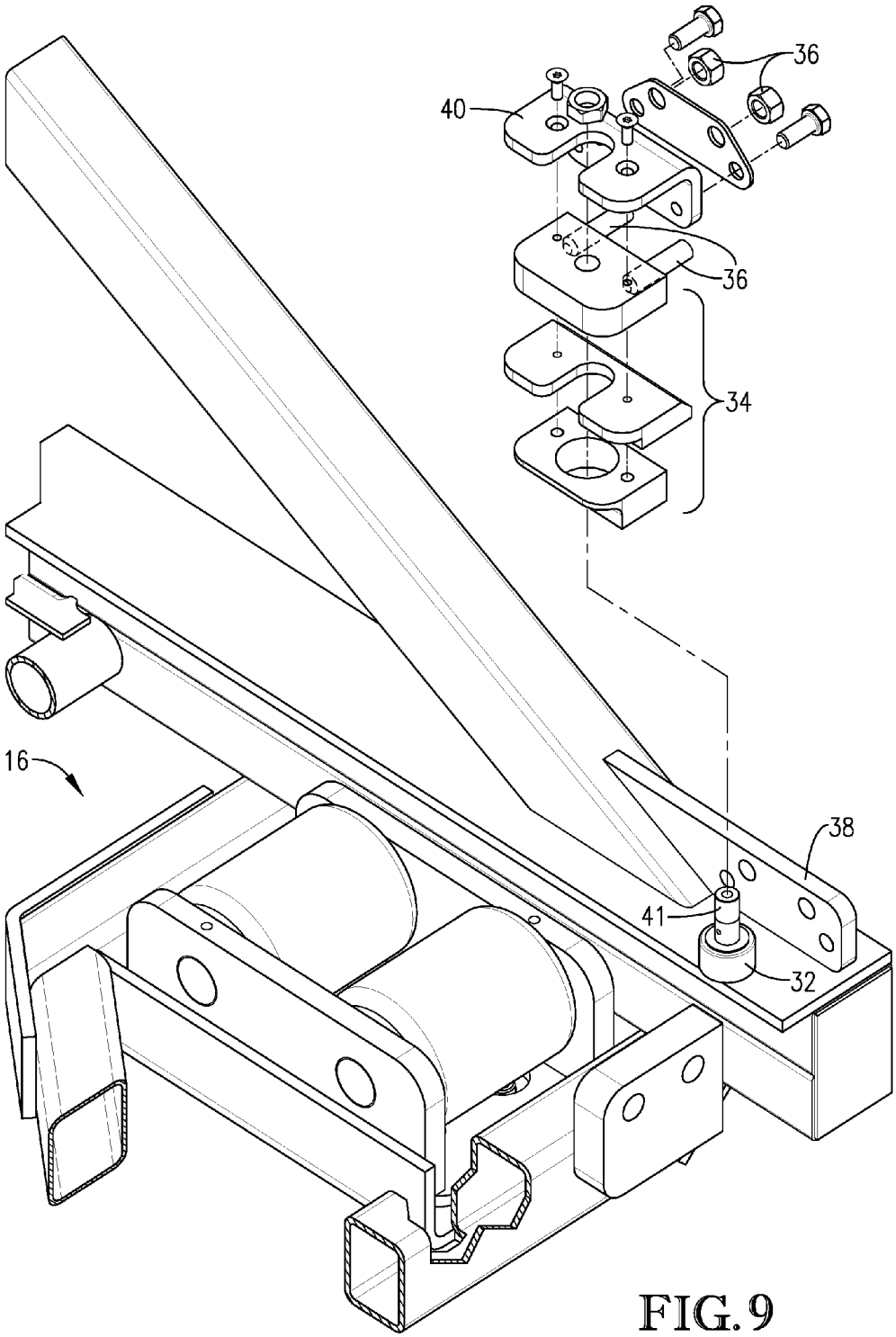
FIG. 9 is a perspective exploded view of a side roller assembly from the third bottom section of FIG. 7.
Figure 10:
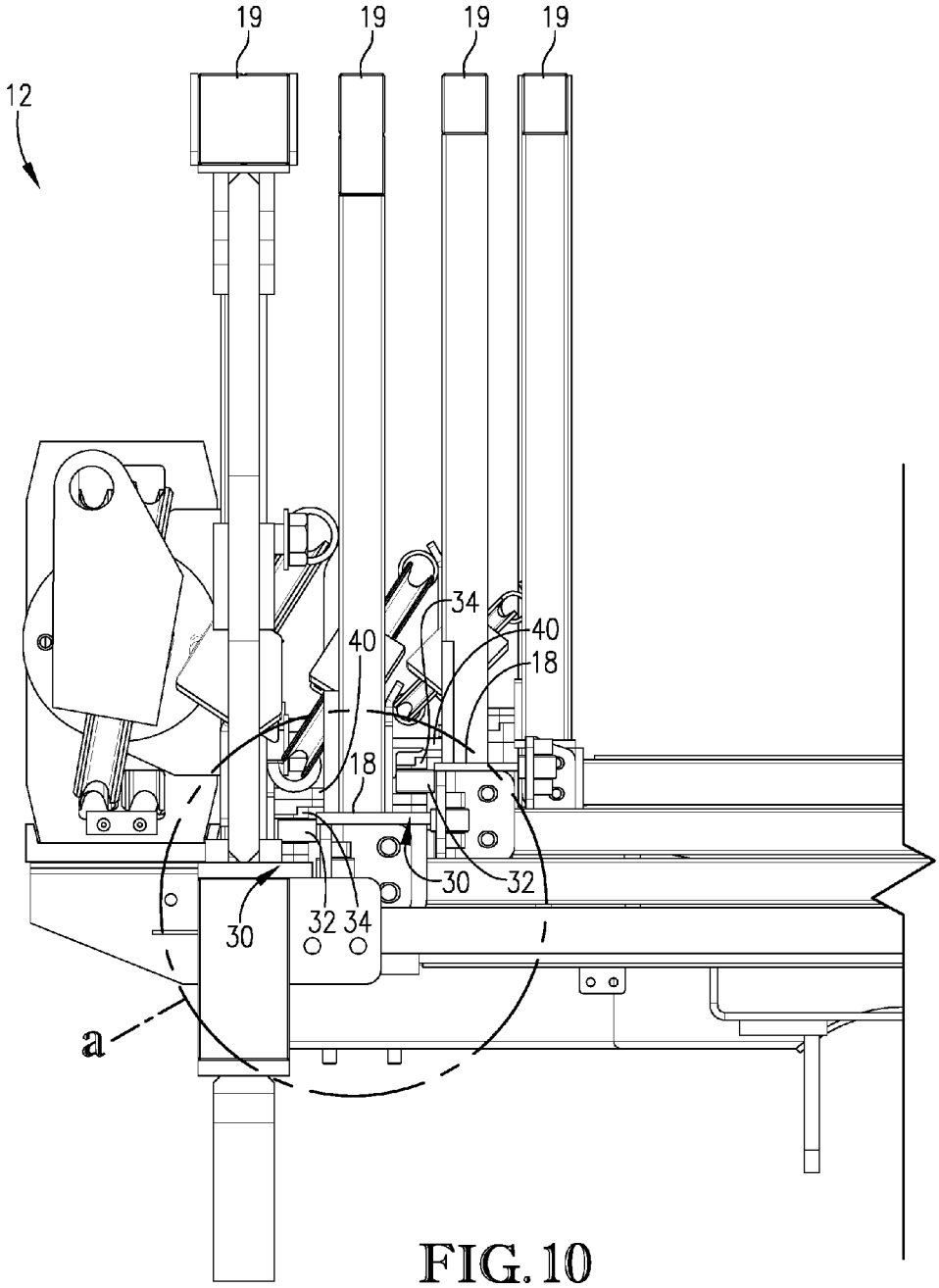
FIG. 10 is a cross-section of the telescopic ladder of FIG. 3 taken along the line 10-10.
Figure 10A:
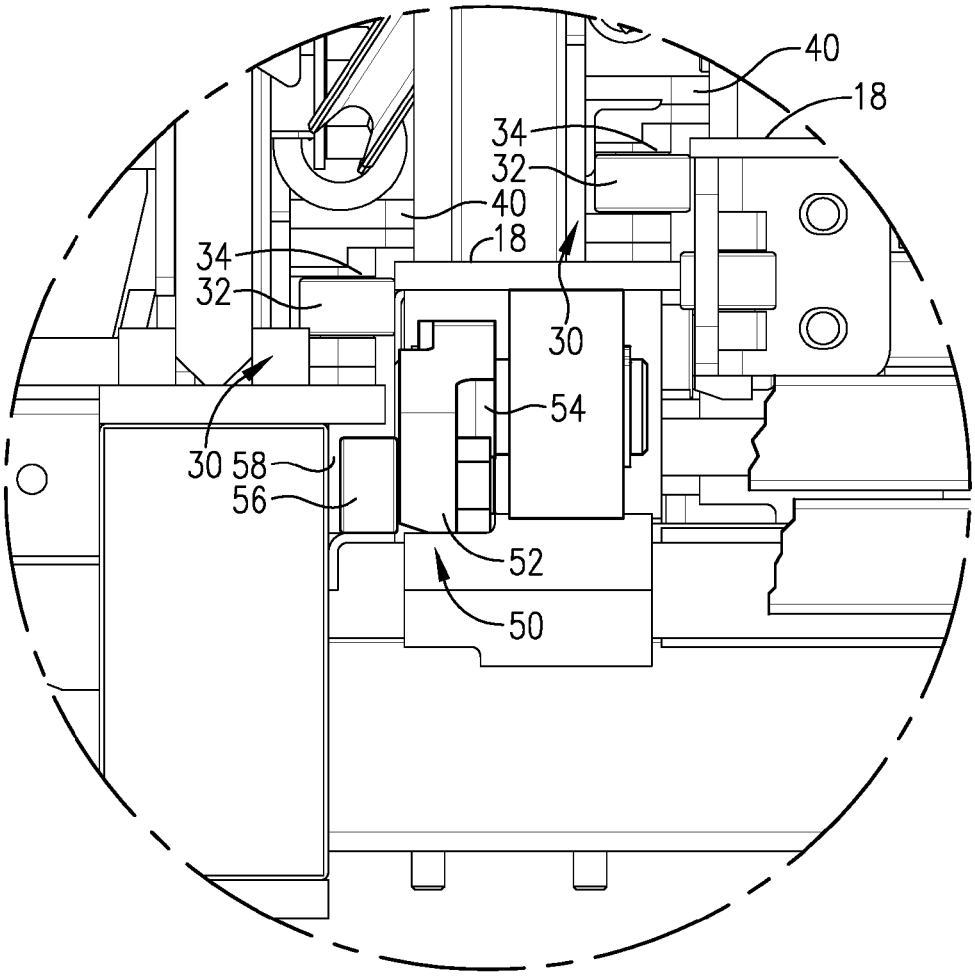
FIG. 10*a* is an enlarged partial view of the circled area labeled "a" of FIG. 10, with a portion of the telescopic ladder removed to shown side roller assemblies and cam-follower assemblies of the present invention.
Figure 11:
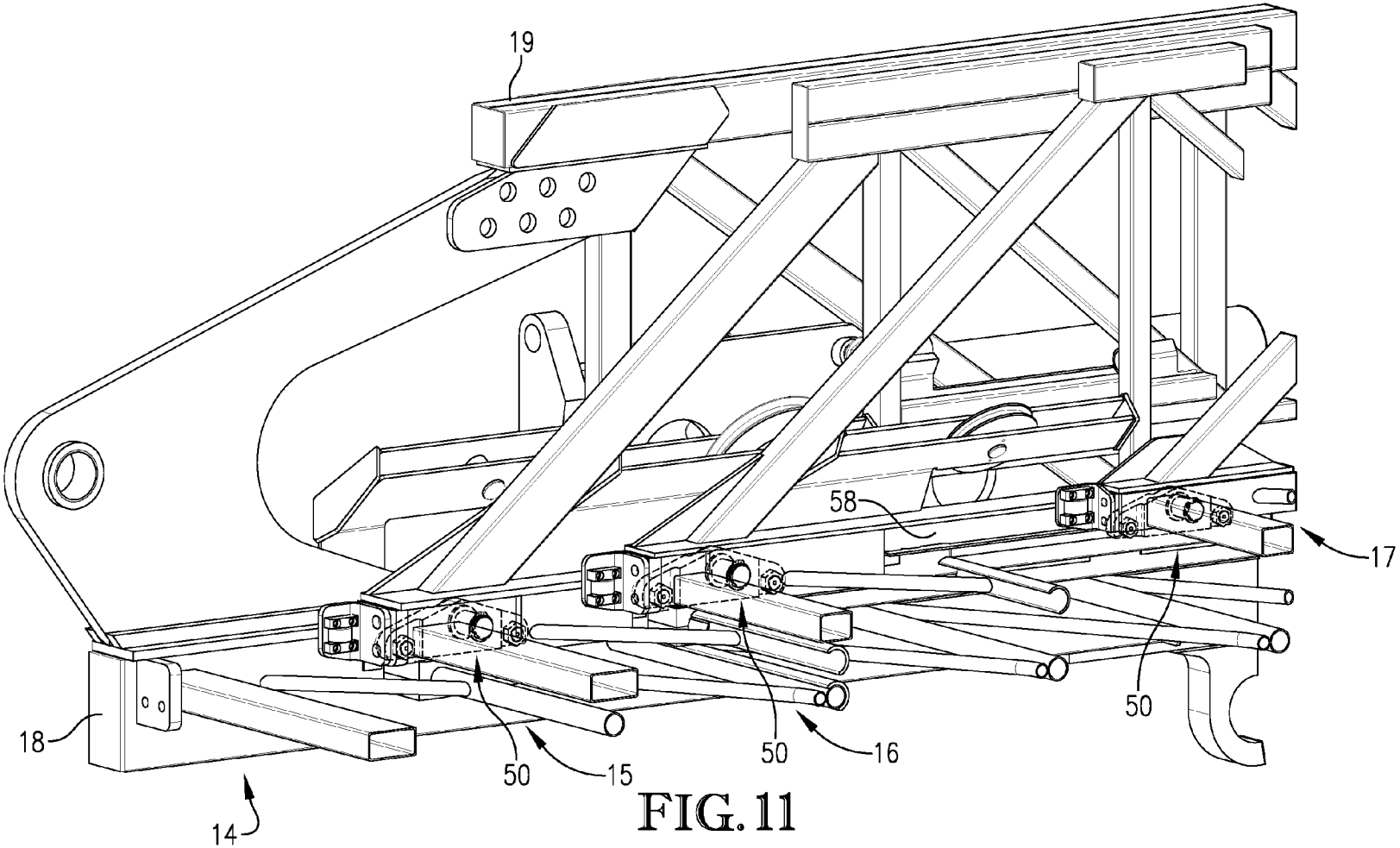
FIG. 11 is a cross-section of the telescopic ladder of FIG. 3 taken along the line 11-11, particularly showing cam-follower assemblies in phantom line.

Turning to FIGS. 8-10*a*, the extension support system may additionally include a plurality of side roller assemblies 30 positioned on each of the lower ladder sections 14, 15, 16 (only the lower section 14 is shown in FIG. 8 and the lower section 16 is shown in FIG. 9). As illustrated by FIG. 8, each lower ladder section 14, 15, 16 may include four or more side roller assemblies 30 located on the left and right sides of the lower ladder sections 14, 15, 16 and positioned towards a front half of the lower ladder sections 14, 15, 16.

Specifically, the side roller assemblies 30 may be positioned on a top surface of the base rails 18 of the lower ladder sections 14, 15, 16. As shown in the drawings, the side roller assemblies 30 may be incorporated on the lower ladder sections 14, 15, 16 in pairs, such that each side roller assembly 30 on one of the base rails 18 is positioned directly across from an opposing side roller assembly 30 on the other of the base rails 18. Although FIG. 8 illustrates a lower ladder section (e.g., lower ladder section 14, 15, 16) having four side roller assemblies 30 (i.e., two on each base rail 14), it is understood that embodiments of the present invention may provide for more or less than four side roller assemblies on each lower ladder section 14, 15, 16.

As shown in FIGS. 8-9, the side roller assemblies 30 may each comprise a side roller 32, a side support bracket 34, a position adjustment mechanism 36, a base section 38, and an overturning restraint component 40. The side rollers 32 may be rotatably secured, along a vertical axis of rotation, within the side support bracket 34. With reference to FIG. 9, each of the side rollers 32 may be supported within its associated side support bracket 34 by way of a pin 41 that is configured to be received within the side support bracket 34. The pin 41 may comprise an axle about which the side roller 32 rotates, such that the pin 41 extends along the axis of rotation of the side roller 32. In some embodiments, the side roller assemblies 30 may additionally include roller bearings positioned between the side rollers 32 and their associated pins 41 to facilitate rotation of the side rollers 32. Furthermore, the side roller assemblies 30 may include end-caps, nuts, washers, and the like, which allow the pins 41 and the side rollers 32 to be secured in position with respect to the side support bracket 34, while facilitating the ability of the side rollers 32 to rotate about their axes of rotation. The side rollers 32 may be formed from various materials, such as metal (e.g., steel, stainless steel, etc.), polymers, or the like.

The side support bracket 34 may be adjustably secured to the base section 38, via the position adjustment mechanism 36. In more detail, as shown in FIG. 9, the base section 38 can be rigidly secured to the top surface of the base rail 18, such as via a mechanical fastener, welding, or the like. With the base section 38 rigidly secured to the base rail 18, the side support bracket 34 and the side roller 32 can be horizontally shifted with respect to the base section 38 via the position adjustment mechanism 36. The position adjustment mechanism 36 may comprise an adjustable bolt, or a nut/bolt combination, or other component that extends from the base section 38 and into the side support bracket 34. As such, the side support bracket 34 (and the roller 32 supported therein) may have their horizontal positions adjusted by actuating the position adjustment mechanism 36. For example, the positions of the side support bracket 34 and the roller 32 can be adjusted inwardly (i.e., toward a longitudinal centerline of the ladder section 14, 15, 16) by actuating the position adjustment mechanism 36 in a first direction (e.g., rotating the nut of the nut/bolt combination in a first direction). Alternatively, the positions of the side support bracket 34 and the rollers 32 can be adjusted outwardly (i.e., away from the longitudinal centerline of the ladder 12) by actuating the position adjustment mechanism 36 in a second direction (e.g., rotating the nut of the nut/bolt combination in an opposite second direction).

As perhaps best shown in FIGS. 8-9, the overturning restraint 40 may be secured to the base section 38 and may extend over a top of the side support bracket 34 and the side roller 32. The overturning restraint 40 may be secured to the base section 38 via mechanical fasteners, welding, or the like. At least a portion of the overturning restraint may be formed from metal (e.g., steel, stainless steel, etc.), nylatron, or combinations thereof.

As will be discussed in more detail below, the side roller assemblies 30 are configured to facilitate extension and retraction of the upper ladder sections 15, 16, 17, while maintaining proper positioning and alignment of the upper ladder sections 15, 16, 17 during extension and retraction and/or during operation of the telescopic ladder 12. For example, with a given upper ladder section 15, 16, or 17 nested within its adjacent lower ladder section 14, 15, or 16, the upper ladder section 15, 16, or 17 will be held centered within the lower ladder section 14, 15, or 16 via the side roller assemblies 30. Specifically, with reference to FIGS. 10 and 10*a*, exterior surfaces of the upper ladder section's 15, 16, or 17 base rails 18 will be in contact with the side rollers 32 of the side roller assemblies 30 of adjacent lower ladder sections 14, 15, or 16, respectively, such that the side roller assemblies 30 keep the upper ladder section 15, 16, or 17 generally centered. Beneficially, the ability for the side roller 32 and the side support bracket 34 to be horizontally shifted ensures that the upper ladder section 15, 16, or 17 can be properly centered. Furthermore, as perhaps best shown by FIGS. 10 and 10*a*, the upper ladder sections 15, 16, or 17 are positioned such that the overturning restraints 40 at least partially overhang the top surface of each of the base rails 18. As such, the overturning restraint 40 is operable to restrict the upper ladder sections 15, 16, 17 from rotating or overturning out of position with respect to adjacent lower ladder sections 14, 15, 16.

Figure 12:
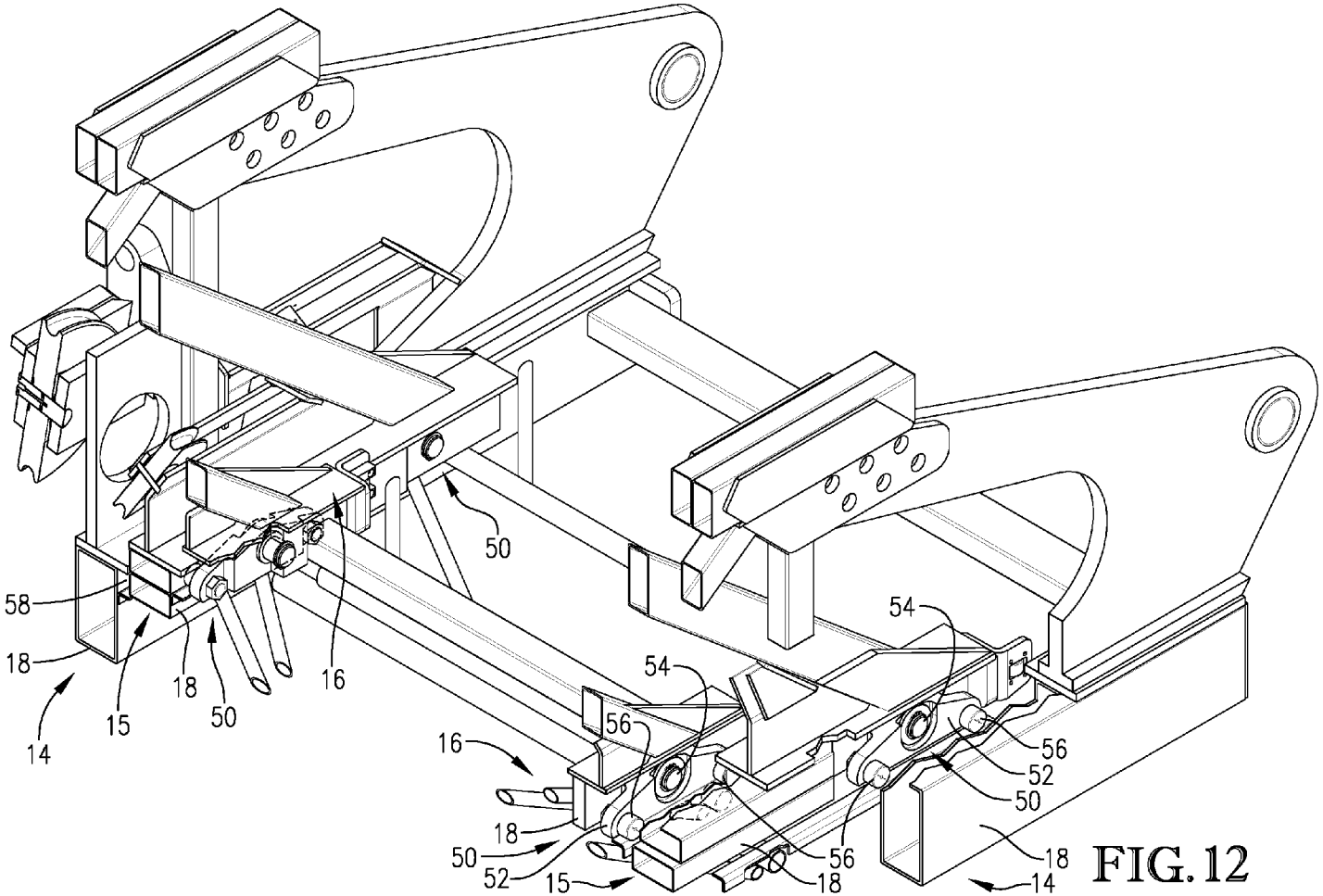
FIG. 12 is a rear perspective partial view of a first ladder section, a second ladder section, and a third ladder section, particularly showing cam-follower assemblies attached to the second and third sections.

With reference to FIGS. 11-15, the extension support system further includes one or more cam-follower assemblies 50 located at a rear portion of each of the upper ladder sections 15, 16, 17. As partially illustrated in FIG. 12, each of the upper ladder sections 15, 16, 17 may include two cam-follower assemblies 50, with one cam-follower assembly 50 positioned on each side of the rear portion of the upper ladder sections 15, 16, 17 (only the cam-follower assemblies 50 of upper ladder sections 15 and 16 are shown in FIG. 12). In particular, the cam-follower assemblies 50 may be positioned on outer surfaces of the base rails 18 of their associated upper ladder section 15, 16, 17, such that the cam-follower assemblies 50 can engage with the adjacent lower ladder sections 14, 15, 16, as will be described in more detail below.

Figures 13, 14:
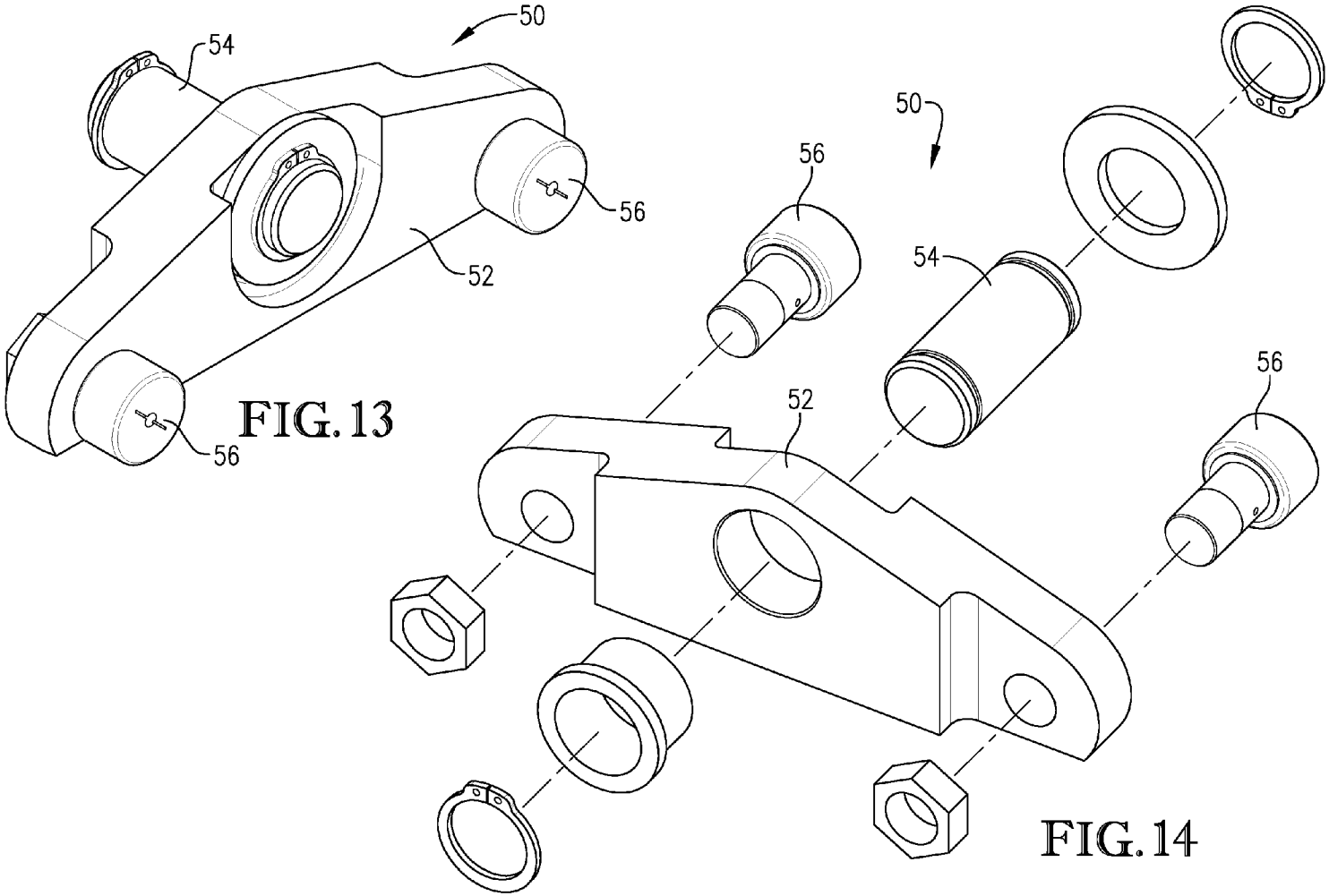
FIG. 13 is a front perspective view of a cam-follower assembly according to embodiments of the present invention.
FIG. 14 is a rear perspective exploded view of the cam-follower assembly of FIG. 13.

With reference to FIGS. 12-14, the cam-follower assemblies 50 may each comprise a mounting housing 52 rotatably secured, via a rotation shaft 54, to the outer surface of the base rail 18 (base rail 18 not shown in FIGS. 13-14). The mounting housing 52 and the rotation shaft 54 may be formed from materials with high strength and durability, such as steel, stainless steel, or the like. The cam-follower assemblies 50 may each further comprise a pair of cam-followers 56 rotatably secured on each opposing end of the mounting housing 52. The cam-followers 56 may be formed from metal (e.g., steel, stainless steel, etc.), polymer, or the like.

With the cam-follower assemblies 50 positioned on the upper ladder sections 15, 16, 17, the cam-followers 56 are configured to be received within cam-follower tracks 58 (See FIGS. 6, 8, 10*a*, and 11-12) formed within the base rails 18 of adjacent lower ladder sections 14, 15, 16. In more detail, the cam-follower tracks 58 may comprise longitudinal openings, grooves, and/or channels formed on the interior surfaces of the base rails 18. As will be described in more detail below, the cam-follower assemblies 50 support the rear portions of the upper ladder sections 15, 16, 17 during extension and retraction, as well as while the upper ladder sections 15, 16, and 17 are in static positions. Furthermore, the cam-follower assemblies 50 provide such support while facilitating the ability of the upper ladder sections 15, 16, 17 to extend and retract from within the lower ladder sections in reduced-frictional manner. Specifically, such reduced-frictional manner of extension and retraction is facilitated by the cam-followers 56, which roll along and/or within the cam-follower tracks 58 during such extension or retraction. As such, the cam-followers 56 support the upper ladder sections 15, 16, 17 with respect to the lower ladder section 14, 15, 16, while facilitating extension and retraction of the upper ladder sections 15, 16, 17 during extension and retraction.

Figures 15, 16:
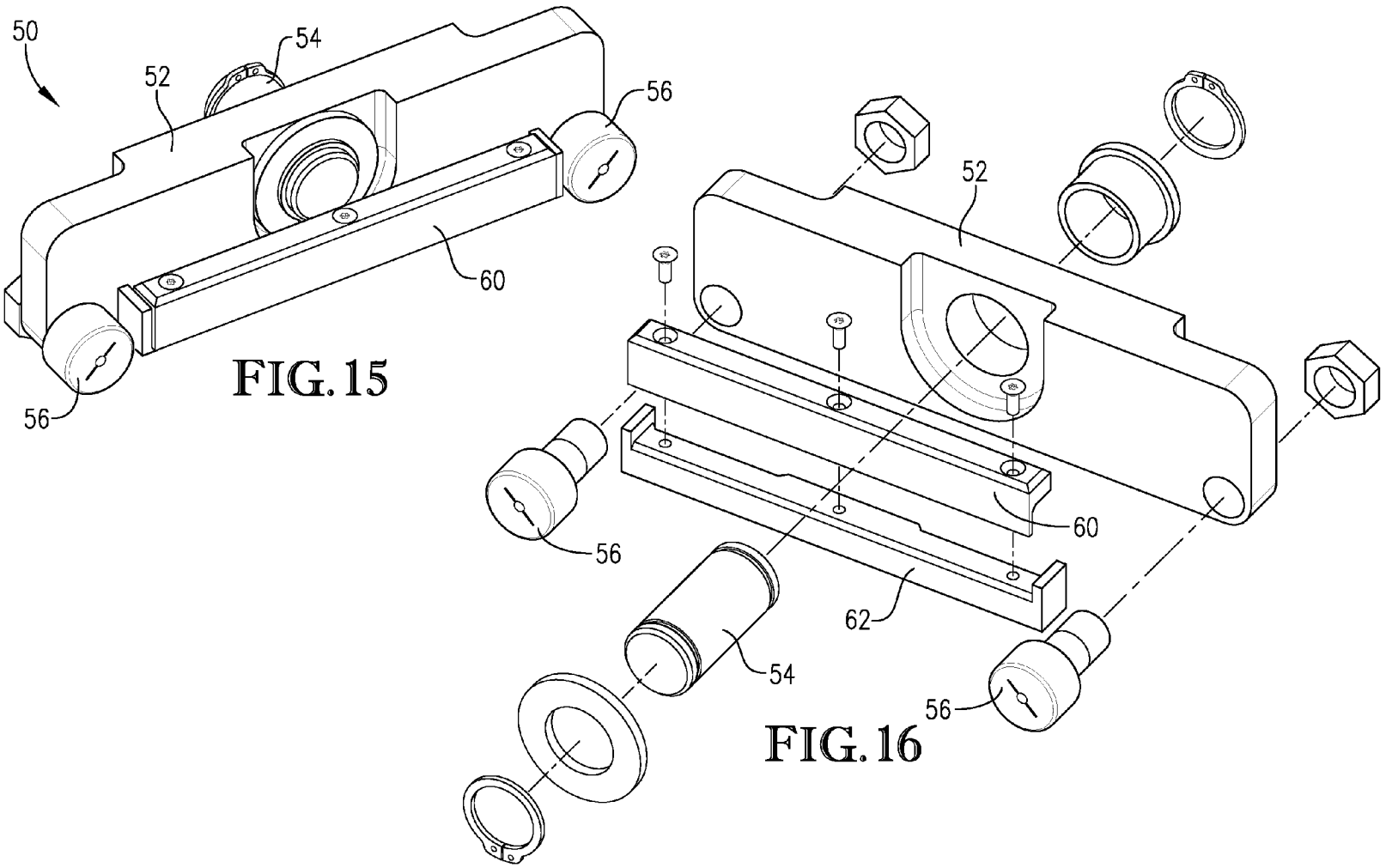
FIG. 15 is a front perspective view of a cam-follower assembly according to an additional embodiment of the present invention.
FIG. 16 is a rear perspective exploded view of the cam-follower assembly of FIG. 15.

With particular reference to FIGS. 15-16, certain embodiments of the present invention provide for the cam-follower assemblies 50 to include a support pad elements 60 secured to the mounting housing 52 between the cam-followers 56. The support pad elements 60 may be secured to the mounting housing 52 via a base element 62, as illustrated in FIG. 17. Specifically, the base element 62 may be rigidly secured to the mounting housing 52 via mechanical fastener, welding, or the like, while the support pad element 60 may be removably secured to the base element 62 via mechanical fasteners or the like. The support pad element 60 may be formed from various materials, such as polymers, nylatron, or the like. The support pad element 60 is configured to provide additional support for the upper ladder sections 15, 16, 17 during extension and retraction from within the lower ladder sections 15, 15, 16, respectively. In particular, the top and/or sides portions of the support pad elements 60 are configured to contact the interior portions of the cam-follower track 58 so as to further support the upper ladder sections 15, 16, 17 during extension and retraction, as well as during operational use of the ladder 12. In certain embodiments, the support pad elements 60 may only be used on the cam-follower assemblies 50 of certain of the upper ladder sections (e.g., sections 15 and 16), which may be required to support the total overall weight of multiple upper ladder sections (e.g., sections 15, 16, and/or 17), as well as any personnel and firefighting equipment (e.g., ladder pipes and discharge monitors).

In operation, the extension support system described above facilitates and enhances the ability of individual sections 14, 15, 16, 17 of the ladder 12 to telescopically extend and retract with respect to each other. Although for brevity the following description of the operation of the ladder 12 is described with reference to a single lower ladder section (i.e., lower ladder section 14) and a single upper ladder section (i.e., upper ladder section 15), it should be understood that the components of the extension support system can similarly be used on other lower ladder sections (e.g., 15 and 16) to facilitate extension and retraction of the other upper ladder sections (e.g., 16 and 17).

To begin operation of the ladder 12, the ladder 12 will generally be in the retracted position, such as shown in FIG. 1, with the upper ladder section 15 retracted within (i.e., nested within) the lower ladder section 14. In such a configuration, the upper ladder section 15 has generally all of its weight (and any weight from other upper ladder sections, e.g., sections 16 and 17) supported by the lower ladder section 14. To accomplish such support, a front portion of the upper ladder section 15 is supported by the front roller assemblies 20 positioned on each of the left and right sides of the front portion of the lower ladder section 14. A rear portion of the upper ladder section 15 is supported by the cam-follower assemblies 50 on the left and right sides of the rear portion of the upper ladder section 15. Specifically, the cam-followers 56 on each of the left and right sides of the rear portion of the upper ladder section 15 are received within the cam-follower tracks 58 formed through the interior surfaces of the base rails 18 of the lower ladder section 14. Furthermore, the upper ladder section 15 is supported in a generally centered position within the lower ladder section 14 via the side roller assemblies 30.

The upper ladder section 15 can be extended out from the front portion of the bottom section 14 via an actuation mechanism, such as a hydraulic actuator, that acts on the rear portion of the upper ladder section 15. It should be understood that in some embodiments, other types of actuating mechanisms may be used to cause the individual ladder sections to extend and/or retract, as was previously described. Once the upper ladder section 15 begins to extend our from the front of the lower ladder section 14, the bottom surface of the base rails 18 of the upper ladder section 15 will begin to roll along the front roller assemblies 20 of the lower ladder section 14. Simultaneously, the cam-followers 56 of the upper ladder section 15 will begin to roll along the cam-follower tracks 58 of the lower ladder section 14.

Beneficially, the elastic devices 28 of the front roller assemblies 20 allow each of the front rollers 22 of the front roller assemblies 20 to remain in constant contact with the base rails 18 of the upper ladder section 15 so as to provide enhanced support and to reduce frictional forces experienced between the lower and upper ladder sections 14, 15 during extraction and retraction. Similarly, the ability for the cam-followers 56 to pivot about their rotation shaft 54 allows each of the cam-followers 56 of the cam-follower assemblies 50 to remain in constant contact with the cam-follower tracks 58 of the lower ladder section 14 so as to provide enhanced support and to reduce frictional forces experienced between the lower and upper ladder sections 14, 15 during extraction and retraction. In embodiments in which the cam-follower assemblies 50 include support pad elements 60, such support pad elements 60 will further enhance the ability of the cam-follower assemblies to provide support between the between the lower and upper ladder sections 14, 15.

Furthermore, it should be understood that when the upper ladder section 15 has at least half of its length positioned over the lower ladder section 14, the cam-followers 56 of the cam-follower assemblies 50 will impart a downward force on the lower ladder section 14 via the cam-follower tracks 58. Alternatively, once the upper ladder section 15 has extended to a point that at least half of its length is extended beyond (i.e., overhangs) the front of the lower ladder section 14, the cam-followers 56 and/or the support pad elements 60 (if included) will impart an upward force on the lower ladder section 14 via the cam-follower tracks 58. Regardless, the receipt of the cam-followers 56 within the cam-follower tracks 58 will provide support to maintain the upper ladder section 15 firmly in place with respect to the lower ladder section 14 during extension and retraction.

Finally, during the extension and retraction of the upper ladder section 15, the upper section 15 is further maintained in a generally centered position with respect to the lower ladder section 14 via the side roller assemblies 30. In particular, the exterior side surface of the base rails 18 of the upper ladder section 15 will roll along the plurality of side rollers 32 of the side roller assemblies 30 of the lower ladder section 14. Beneficially, the position adjustment mechanisms 36 of the side roller assemblies 30 allow the side 32 rollers to be precisely positioned so as to accurately support the upper ladder section 15 in a centralized manner with respect to the lower ladder section 14. Furthermore, the side roller assemblies 30 are configured to provide lateral support to the ladder 12 during operation of the vehicle 10, such as during use of ladder pipes or discharge monitors that are operated from the end of the ladder 12. Furthermore still, the overturning restraint 40 restricts vertical movement of the base rails 18 of the upper ladder section 15 so as prevent the upper ladder section 15 from overturning or tipping during extension or retraction or during operation of the ladder 12 and the vehicle 10.

Embodiments of the present invention are configured to minimize the frictional forces experienced between the individual sections 14, 15, 16, 17 during extension and retraction. For instance, embodiments of the present invention provide for a dynamic coefficient of friction experienced by the upper ladder sections 15, 16, 17 with respect to the lower ladder sections 14, 15, 16 during extension and retraction to be less than 0.15, less than 0.125, less than 0.10, less than 0.075, or less than 0.0305, or alternatively, between 0.0305 and 0.15, between 0.075 and 0.125, or between 0.8 and 0.10, as measured according to ASTM D1784 or PTM55008. Such a minimized coefficient of friction being due, at least in part, to the each of the following: front roller assemblies 20 of the lower ladder section 14, 15, 16, the side roller assemblies 30 of the lower ladder sections 14, 15, 16, the cam-follower assemblies 50 of the upper ladder sections 15, 16, 17, or combinations thereof. Beneficially, the extension support system of embodiments of the present invention provides for such reduced coefficient of friction without the use of lubricants, such as grease-type or liquid-type lubricants that are often used with nylatron products. Such reduced friction enhances the longevity of the ladder 12 and its components, such as the individual ladder sections 14, 15, 16, 17, the actuating mechanisms (e.g., hydraulic systems, cable systems, etc.), and the extension support systems. Furthermore, the extension support system as described above is configured to provide for extension and retraction of the individual ladder sections in a smooth, continuous manner.

Furthermore, as noted above, the extension support system of the present invention facilitates the generation of more uniform frictional forces between the extending and/or retracting ladder sections 14, 15, 16, 17. The generation of uniform frictional forces allows for a smoother operation of the ladder 12, particularly with respect to previously-used ladders, such as previously-used ladders that incorporate pad-based systems. Specifically, in some previously-used ladders, frictional forces are often high enough to cause a "slip-stick" effect, whereby during extension and/or retraction of the ladders sections, the ladder sections will intermittently be overcome by frictional forces and will entirely stop moving. It is generally understood that it requires a stronger force to overcome a frictional force between two objects if the objects are not moving with respect to each other than if the objects are moving with respect to each other. As such, in previously-used telescopic ladders that experienced "slip-stick," the force required to overcome the "stick" would impart an impulsive, jerky movement to the ladder sections. Embodiments of the present invention provide for a reduced, uniform frictional force between the ladders sections, thereby providing a smoother operation that avoids such "slip-stick" effects often experienced by previously-used ladders.

Although the invention has been described with reference to the preferred embodiment(s), it is noted that equivalents may be employed and substitutions made herein without departing from the scope of the invention. Thus, the invention described herein is entitled to those equivalents and substitutions that perform substantially the same function in substantially the same way.

Having thus described various embodiments of the invention, what is claimed as new and desired to be protected by Letters Patent includes the following:

1. A firefighting vehicle comprising:

a vehicle body;

a telescopic ladder attached to said vehicle body, wherein said telescopic ladder includes a first ladder section and a second ladder section, with said second ladder section being configured to telescopically extend from said first ladder section; and an extension support for facilitating the extension of said second ladder section with respect to said first ladder section, wherein said extension support provides for said second ladder section to extend from said first ladder section while experiencing a coefficient of friction of less than 0.10, wherein said extension support comprises one or more front roller assemblies secured to a front portion of said first ladder section, wherein said front roller assemblies include front rollers configured to allow said second ladder section to roll over said front roller assemblies, and wherein said front rollers are formed from polyurethane.

2. The firefighting vehicle of claim 1, wherein said front roller assemblies further include one or more elastic devices configured to allow each of said front rollers of said front roller assemblies to maintain simultaneous contact with said second ladder section.

3. The firefighting vehicle of claim 2, wherein said elastic devices comprise Belleville springs.

4. The firefighting vehicle of claim 1, wherein said extension support comprises two or more laterally-aligned side roller assemblies located on opposite sides of said first ladder section, and wherein said second ladder section is configured to roll between said side roller assemblies.

5. The firefighting vehicle of claim 4, wherein the second ladder section comprises base rails and where in the base rails of said second ladder section are configured to contact said side roller assemblies as said second ladder section extends or retracts from said first ladder section, such that said side roller assemblies provide lateral support for said second ladder section.

6. The firefighting vehicle of claim 4, wherein said side roller assemblies each comprise a side roller and a position adjustment mechanism, and wherein said position adjustment mechanism is configured to adjust said side roller inward and outward with respect to a longitudinal centerline of said first ladder section.

7. The firefighting vehicle of claim 4, wherein said second ladder section comprises base rails and wherein said side roller assemblies each comprise an overturning restraint configured to overhang at least a portion of a base rail of said second ladder section.

8. The firefighting vehicle of claim 1, wherein said extension support comprises a cam-follower assembly located on each side of a rear portion of said second ladder section.

9. The firefighting vehicle of claim 8, wherein said first ladder section includes cam-follower tracks formed on interior-facing sides of base rails of said first ladder section, and wherein at least a portion of said cam-follower assemblies are configured to be received in said cam-follower tracks, such that said cam-follower assemblies are operable to translate along said cam-follower tracks.

10. The firefighting vehicle of claim 9, wherein said cam-follower assemblies each comprises a pair of cam-followers, and wherein said cam-follower assemblies are each rotatably mounted to the sides of the second ladder section, such that the cam-followers of each cam-follower assembly are operable to maintain simultaneous contact with said first ladder section.

11. The firefighting vehicle of claim 1, wherein said extension support provides for said second ladder section to extend from said first ladder section while experiencing a coefficient of friction of less than 0.05.

12. The firefighting vehicle of claim 11, wherein said extension support provides for said second ladder section to extend from said first ladder section, while experiencing a coefficient of friction of less than 0.05, without the use of grease or liquid lubrication.

* * * * *